United States Patent [19]

Mossiossian et al.

[11] 4,137,722

[45] Feb. 6, 1979

[54] COUPLING BETWEEN AN ABOVE SEA-LEVEL PLATFORM AND A BELOW-WATER FOUNDATION

[76] Inventors: Varoujan Mossiossian, Chattenweg 2, 6204 Taunusstein-Hambach, Hessen; Karol Bayer, Geislingerstr. 19, 7 Stuttgart-Wangen, Wurttemberg, both of Fed. Rep. of Germany

[21] Appl. No.: 739,747

[22] Filed: Nov. 8, 1976

[30] Foreign Application Priority Data

Nov. 6, 1975 [DE] Fed. Rep. of Germany ..... 2549859

[51] Int. Cl.[2] ..... E02B 17/00

[52] U.S. Cl. ..... 405/202; 285/262; 403/123

[58] Field of Search ..... 61/95, 86, 96, 101, 61/69 R; 9/8 P; 403/123; 175/7; 285/262

[56] References Cited

U.S. PATENT DOCUMENTS

| | | | |
|---|---|---|---|
| 918,443 | 4/1909 | Greenlaw | 403/123 X |
| 3,522,709 | 8/1970 | Vilain | 61/95 |
| 3,667,239 | 6/1972 | Mott | 61/95 |
| 3,667,240 | 6/1972 | Vilain | 61/95 |
| 3,766,582 | 10/1973 | Lloyd | 61/95 |
| 4,048,944 | 9/1977 | Corgnet | 61/95 X |
| 4,069,682 | 1/1978 | Taylor et al. | 61/95 |

*Primary Examiner*—Jacob Shapiro
*Attorney, Agent, or Firm*—Wooster, Davis & Cifelli

[57] ABSTRACT

The invention relates to an above sea-level platform, for use as, for example, an oil-rig, which is connected to a sea-bed foundation by a ball-joint arrangement. For protection, the ball joint is hollow and partially received in a recess at the lower end of a tubular extension of the platform through which an oil conduit leads from the foundation via the hollow ball joint, the two parts of which are held in sealing abutment by a draw member.

10 Claims, 3 Drawing Figures

COUPLING BETWEEN AN ABOVE SEA-LEVEL PLATFORM AND A BELOW-WATER FOUNDATION

BACKGROUND OF THE INVENTION

This invention relates to a coupling for use between an above-water platform or the like which is spaced above the surface of the water and a foundation which is anchored in or on the sea bottom.

There are at least two types of above-water platforms as used primarily in petroleum drilling or petroleum conveying operations. In one type the platform is connected directly and in non-yielding fashion to the foundation through a tower shaft, which inhibits any relative movement between the sea bottom and the oil drilling platform. In the second type use is made of a floating construction which allows for inclination in reponse to movements of the surface of the sea under the effect of wind or the like, and in this case use is made of cables, anchors, hawsers or the like to hold the platform in position. Where this construction is used as an oil transfer station or platform only, the oil feed conduit is pivotally connected to the latter.

The first type of above-water platform makes considerable demands on material and is expensive; inter alia this is due to the fact that heavy bending stresses are involved and the fixed end movement between the tower shaft and the foundation has to be compensated.

In the second type an adjustable coupling is provided between the foundation which carries the oil conduit and the oil feed pipe which is supported for example by a steel frame, but the appropriate jointing can only for example be reached by divers. The petroleum conduit — provided with at least one joint — can itself incline to the vertical within a certain range. A further disadvantage of this form of oil trans-shipment platform is that the oil conduit lies in the sea water and is directly exposed to acts of sabotage.

BRIEF SUMMARY OF THE INVENTION

It is an object of this invention to provide a coupling between the above-water platform and the sea-bed foundation which is of such a nature that on the one hand there is adequate protection of the petroleum conduit — even in relation to its coupling to the foundation — and on the other hand the constructional expense in relation to the fixed tower shaft is kept optimally small.

This object is met in the present invention by the fact that in the case of an above-water platform or the like of the above-mentioned type the coupling comprises a tubular hollow body which comprises or accommodates the oil conduit, and is connected to the foundation through a partly hollow ball-joint having at least one draw member. Pre-stressed steel concrete pipes or even steel pipes can be used as the hollow body.

The term above-water platforms in the sense of the present invention is to be understood to refer not only to constructions which may be used for the preparation and the performance of oil drilling, but can also refer to platforms which are brought into use after the drilling has been made and are used then to pump the oil into the tanker or the like. Thus the hollow body in the first place is to be regarded as a so-called transfer tower; a multiple use of such a hollow body to incorporate a drilling platform, that is to say for actually performing the drilling for oil, is however also possible.

A preferred embodiment of the invention resides in the fact that the oil conduit is passed through the ball joint; alternatively the oil conduit may be provided in the ball joint with its own individual joint connection; it may however be flanged above and below the ball joint and the hollow space in the ball joint itself can be used as a coupling conduit.

Further it is possible for the hollow body to be made of cylindrical form and the inner chamber thereof provided with at least one riser. This provides for access to the complete oil conduit above the sea bed and the coupling between the foundation and the drilling tower.

The oil conduit in the hollow body can itself be accessible from all sides. This means that the replacement of any individual parts of the pipe or even their inspection to see whether there are any leakages can be performed without difficulty.

The hollow body can be provided at its foundation end with an approximately hemi-spherical cavity and adjoining this a central bore with a substantially larger cross-section than that of the oil conduit; the cavity is advantageously given a polytetrafluoroethylene (PTFE) lining; in a preferred embodiment the PTFE lining merges into a ring seal at the bottom face of the hollow body.

The inner part of the ball joint which is anchored to or in the foundation can be made as a hollow body and for example provided with a plurality of radially-extending reinforcing plates in its interior; in this connection reference is specifically made to the fact that the two parts of the ball joint can be mirror-image reversed, that is to say the hollow body can carry the inner part of the ball and the foundation the approximately semi-circular cavity. The inner rims of the reinforcing plates will advantageously conform to the spherical shape.

In another possible arrangement the draw member comprises a draw bar which is rotatably mounted in the ball joint, for example through the agency of a cardan joint; the draw bar is advantageously mounted in a plate anchored in the hollow body and may be capable of pre-stressing; in another possible arrangement the cardan joint is composed of an eye of the draw bar which embraces a cross-bar in cardan fashion.

BRIEF DESCRIPTION OF THE DRAWINGS

An example of embodiment of the invention is shown in the drawings in very diagrammatic representation. In these drawings.

DETAILED DESCRIPTION OF THE DRAWINGS

Figure 1:
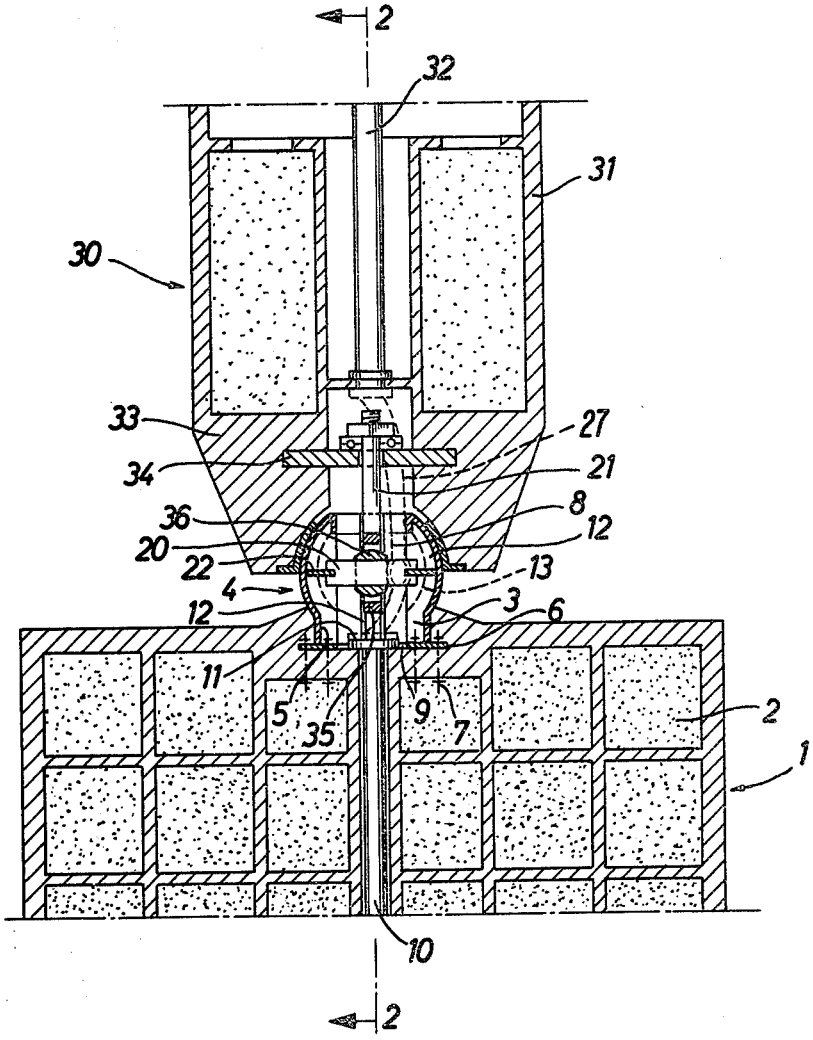
FIG. 1 is a part section through a coupling between a hollow body and a foundation.
Figure 2:
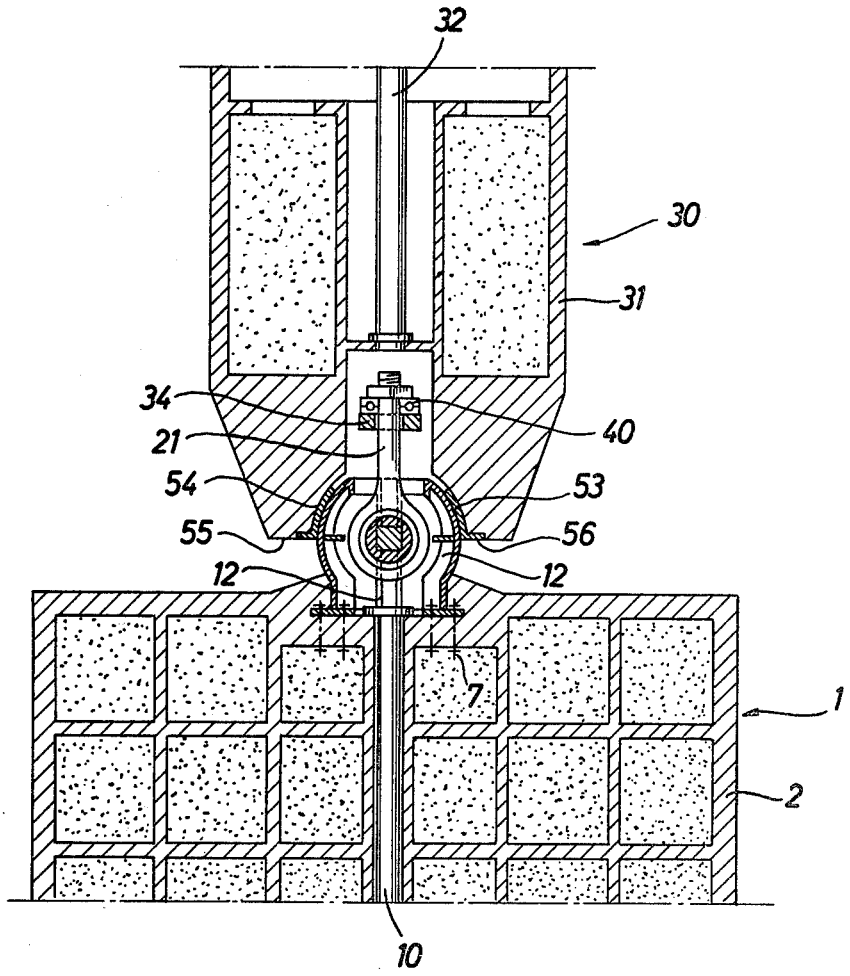
FIG. 2 is a section on the line 2—2 of FIG. 1.
Figure 3:
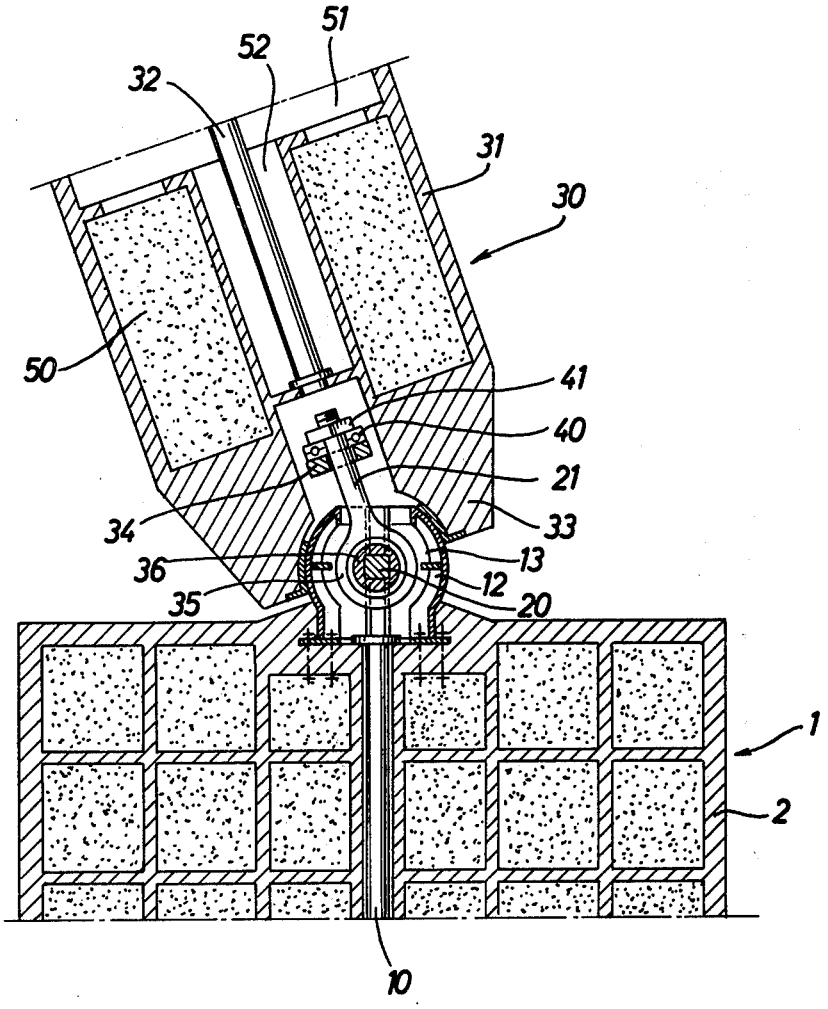
FIG. 3 is an illustration similar to that of FIG. 2 but showing the hollow body in an inclined disposition.

A foundation 1 for example of caisson form anchored or mounted on the sea bed is of cubic construction and has a number of individual chambers 2 which are filled with a ballast material in the usual way. The foundation may alternatively be made of substantially larger size and be equipped with oil storage chambers.

The multi-chamber foundation 1 has at the centre a hollow area 3 in which is mounted the inner part of a ball joint 4. The rim of the inner part 5 of the ball joint is cylindrical and merges into a plate 6 which for example is connected to the foundation by means of threaded bars 7. A part of the ball joint 4 has a cylindrical hollow chamber 8, and plate 6 has a central opening 9 through which the oil feed conduit 10 passes. The flange 11 of the hollow conduit 10 rests on plate 6.

The ball joint 4 has, internally, radially extending reinforcing plates or reinforcing ribs 12, the inner edge 13 of which conforms with the ball shape.

Such reinforcing ribs are provided in pairs in the vicinity of the joint with a guide rod 20, which is of square cross-section for a draw member 21. The square section guide rod is non-rotatably connected to the inner side of the ball joint through the agency of two plates 22.

The hollow body 30 which is to be connected to the foundation 1 in the present instance comprises a reinforced steel pipe, the outer wall 31 of which carries a longitudinal sheathing, which preferably also is an annular sheathing. This sheathing can be prestressed. The petroleum conduit 32 runs through the centre of this cylindrical hollow body; this conduit leads to a transshipment platform provided with a pumping station and disposed above the surface of the water, and tankers can be "loaded" from this platform.

The hollow body is provided with at least one driving body beneath the surface of the water in the vicinity of the latter, this body simulating a hydrometer.

The strongly reinforced end 33 of the steel concrete hollow body has a steel cross piece in the form of a plate 34 having an opening for receiving the draw member 21 which takes the form of a draw bar. The lower end of the draw member has an eye 35.

Provided on the guide bar 20, which in the example illustrated is of square section, is an annular body 36 which allows not only for rotation of the steel concrete hollow body at right angles to the plane of the drawing but also parallel to this; this enables the hollow body 30 to move universally around the centre of the joint.

Assuming for example that the length of the hollow body is 150 to 200 meters, inclinations of a maxima ± 20° are normally admissible; such tilting is acceptable without any problem in the case of the joint 4 illustrated.

Provided on the cross piece plate 34 is a horizontally rotatable bearing 40 for example in the form of a taper bearing. By this means the draw bar 21 can be tightened by the nut 41 to seal the ball joint against the pressure of the ambient water.

Above its solid end 33 the hollow body has an annular chamber 50 which can be filled in the usual way with ballast. Above this annular chamber is a further annular chamber 51. This too can of course be filled with ballast or can be completely empty, thus avoiding interference with the axis of the oil conduit 32 within the vicinity of the coupling joint; the oil conduit is passed through the annular hollow chamber 52 and is connected to the hollow body at spaced points.

In the embodiment illustrated a hollow space is provided between the two oil feed pipe parts 10 and 32. Instead of using this hollow space the petroleum conduit could be passed through the ball joint and a special joint provided for the oil conduit at this part as shown in dotted lines at 27 of FIG. 1. This arrangement thus caters for a checking of the coupling between the foundation 1 and the oil body 30 during actual operation. In the arrangement illustrated, however, the oil conduit first has to be shut off in the foundation and the part of this conduit above this point pumped out.

The ball joint is received in the hollow body in a cavity 53 of approximately semi-circular cross-section, this having a PFTE lining 54. The PTFE lining merges into a ring seal 56 at the bottom surface 55 of the hollow body lying opposite to the foundation 1. This caters for absolute sealing tightness between the ball joint and the hollow body preventing the penetration of water into the joint area and thus into the hollow body.

We claim:

1. A coupling for an above sea-level platform and a foundation secured to the sea bed, said platform having a tubular hollow body, a ball joint consisting of two hollow ball members connecting said tubular hollow body to said foundation, said ball joint being partly hollow in construction and having a tensioned draw member to ensure a liquid-tight seal in said ball joint, said draw member comprising a draw bar one end of which is rotatably mounted to and within one hollow ball member of said ball joint by means of a cardan joint, the opposite end of said draw bar being mounted to said tubular hollow body or to said foundation, said draw bar drawing both said hollow ball members of said ball joint together into the liquid-tight seal, said tubular hollow body and said ball joint providing a passageway from said above sea-level platform to said foundation.

2. A coupling according to claim 1 wherein a pipe is disposed in the said passageway for carrying petroleum or the like from an oil feed conduit exposed to said passageway at said foundation to the above sea-level platform, said pipe including a bendable joint connection within said ball joint, the remainder of the said passageway surrounding said pipe providing access to said pipe, the interior of said ball joint, and said foundation.

3. A coupling according to claim 1 wherein a pipe is flanged to said interior of said tubular hollow body adjacent said ball joint, said pipe extending from the flanged connection through said passageway to said above sea-level platform, the lower end of said pipe being in communication with an oil feed conduit in said foundation through the interior of said ball joint, said ball joint thereby forming a coupling channel between said oil feed conduit and said pipe, and said passageway above said flange providing access for inspection and maintenance of said pipe.

4. A coupling according to claim 1 wherein the tubular hollow portion is cylindrical.

5. A coupling according to claim 1 wherein said tubular hollow body is provided with a cavity at an end thereof confronting said foundation, said cavity comprising one of the hollow ball members of said ball joint rotatably receiving the other hollow ball member of said ball joint, and said draw bar is mounted to said tubular hollow body for drawing said ball joint into a liquid-tight seal.

6. A coupling according to claim 5 wherein said cavity has a polytetrafluoroethylene lining which comprises a part-spherical concave portion of said ball joint, said lining terminating in a ring seal disposed about the other part of said ball joint.

7. A coupling according to claim 1 wherein a ball member of the ball joint is hollow and reinforced with internal vanes or plates.

8. A coupling according to claim 7 wherein inwardly-facing edges of the vanes or plates conform to the spherical shape of the ball joint.

9. A coupling according to claim 1 wherein said cardan joint is set in an eye formed in one end of said draw bar and said eye encircles an annular body of a cross bar, said cross bar being secured to one of said hollow ball members.

10. A coupling according to claim 9 wherein said opposite end of said draw bar is mounted above an opening of a plate anchored in said tubular hollow body.

* * * * *